United States Patent [19]

Kinoshita et al.

[11] Patent Number: 4,887,131

[45] Date of Patent: Dec. 12, 1989

[54] DEVELOPING APPARATUS USING MAGNETIC PARTICLES AND TONER PARTICLES

[75] Inventors: Masahide Kinoshita, Yokohama; Hatsuo Tajima, Matsudo; Norihisa Hoshika, Kawasaki; Hiroshi Tajika, Yokohama; Atsushi Hosoi, Tokyo, all of Japan

[73] Assignee: Canon Kabushiki Kaisha, Tokyo, Japan

[21] Appl. No.: 168,517

[22] Filed: Mar. 15, 1988

[30] Foreign Application Priority Data

Mar. 16, 1987 [JP] Japan ..... 62-060452
Mar. 16, 1987 [JP] Japan ..... 62-060460

[51] Int. Cl.[4] ..... G03G 15/09

[52] U.S. Cl. ..... 355/253; 118/657; 355/251

[58] Field of Search ..... 355/3 DD, 14 D, 251, 355/253; 118/657, 658

[56] References Cited

U.S. PATENT DOCUMENTS 4,386,577 6/1983 Hosono et al. ..... 118/657
4,391,512 7/1983 Nakamura et al. ..... 118/657 X
4,511,239 4/1985 Kanbe et al. ..... 355/3 DD
4,517,274 5/1985 Honda et al. ..... 118/657 X
4,559,899 12/1985 Kan et al. ..... 355/3 DD X
4,607,938 8/1986 Hosoi et al. ..... 355/3 DD
4,653,427 3/1987 Hosaka et al. ..... 118/658

*Primary Examiner*—Fred L. Braun
*Attorney, Agent, or Firm*—Fitzpatrick, Cella, Harper & Scinto

[57] ABSTRACT

A developing apparatus for developing an electrostatic latent image on an electrostatic latent image bearing member includes a container for containing a developer which contains toner particles and magnetic particles, a developer carrying member, opposed to the electrostatic latent image bearing member, for forming a developing position for supplying the toner particles to the latent image bearing member and for carrying the developer from the container to the developing position, magnetic field generating magnet disposed across the developer carrying member from the latent image bearing member for generating a magentic field, developer regulating member for regulating the developer which contains the toner particles and carrier particles and which is carried to the developing position, wherein the magnetic field generating magnet includes one magnetic pole adjacent an upstream side of the regulating member with respect to a movement direction of the developer carrying member, and wherein a magnetic flux density downstream of the one pole less steeply decreases the increase thereof at an upstream side.

15 Claims, 7 Drawing Sheets

DEVELOPING APPARATUS USING MAGNETIC PARTICLES AND TONER PARTICLES

FIELD OF THE INVENTION AND RELATED ART

The present invention relates to a developing apparatus using magnetic particles (two component developer) usable with a displaying apparatus, a printer, a facsimile machine and an electrophotographic apparatus wherein images are formed.

Japanese Laid-Open Patent Application No. 3206/1980, which has been assigned to the assignee of the present invention, has proposed a developing system wherein a development efficiency is increased in a conventional magnetic brush type development using a two component developer, and wherein a magnetic brush is formed in an alternating electric field at a developing station so that the non-magnetic toner carried on the magnetic brush at the base portion thereof, in addition to those at the edges of the magnetic brush, are used for development, thus increasing the development efficiency. By this, an excellent high quality image can be produced.

However, in the developing method as in this Japanese Laid-Open Patent Application, wherein a great amount of the magnetic brush is formed, a change of the toner content in the developer container directly influences the quality of the image. Therefore, it is inevitable that the toner content in the developer container is controlled properly, and therefore, it is not possible or practical to omit a toner content control means. In addition, the development efficiency is far better than the conventional developing method, but great amounts of magnetic particles and toner particles are still required to be conveyed wastefully.

U.S. Ser. Nos. 906,080 and 015,929 filed Sept. 10, 1986 and Feb. 18, 1987, which are assigned to the assignee of the present invention, propose developing methods wherein the development efficiency is almost 100%. Those patent applications propose, as contrasted to the conventional developing method using the two component developer, in order to form a thin layer of two component developer, that a regulating magnetic pole is disposed opposed to an upstream side of a regulating means having an integral magnetic blade and non-magnetic blade with respect to movement direction of the sleeve interposed between the regulating means and the regulating magnetic pole, and wherein a position of the maximum magnetic flux density on the surface of the sleeve provided by the regulating magnetic pole is opposed to a surface of the regulating means where the magnetic particles are overturned.

Further, in the U.S. applications, the developer is substantially packed in the developer regulating position or zone, and the state of being packed is stabilized so that the toner particles which are not sufficiently charged triboelectrically are removed, that the charging of the toner is improved and that only the toner particles that are uniformly and sufficiently triboelectrically charged are conveyed to the developing position. The state of the packing is one of the most important factors controlling the charging to the toner, and therefore, the stabilized state of packing is almost equivalent to maintenance of good quality of images for a long term. The state of the packing is influenced by the following:

(1) A gap between the regulating member (blade) for regulating an amount of the developer applied on a developer carrying member (a developing sleeve) and the developer carrying member;

(2) A magnetic field present in the regulating position adjacent the regulating member (blade), more particularly, the strength of the magnetic pole for the developer amount regulation and the magnetic flux density on the surface of the developing sleeve;

(3) A relative position between the developer amount regulating member and the regulating magnetic pole such as an angle $\theta$ formed between a free end of the regulating member and a position of the maximum magnetic flux density provided by the regulating pole;

(4) A configuration of a magnetic particle limiting member.

There are other various factors influential to the state of the packing, but the above enumerated four elements are predominant as long as the structure of the developing apparatus is concerned.

Accordingly, by optimizing those factors, a stabilized state of packing can be maintained, whereby stabilized images can be provided for a long term. Noting those elements, it becomes possible to accomplish a developing apparatus which does not require an automatic toner supplying means for maintaining a constant toner content and which can be made disposable and which is small in size.

The above mentioned U.S. Ser. No. 906,080 also proposes that the volumetric ratio of the magnetic particles in the developing position is made 1.5–30%, whereby excellent image formation is accomplished together with the function of an alternating electric field generating means.

On the other hand, the recent trend toward smaller size of the image forming apparatus necessarily requires a smaller developing apparatus including a smaller diameter developing sleeve. However, with the decrease of the developing sleeve diameter, it becomes difficult to maintain the state of the packing. More particularly, the smaller developing sleeve necessarily requires a smaller magnet contained in the developing sleeve, and it becomes difficult to provide a required strength of the magnetic pole for the developer regulation. This narrows the latitude for the magnetic field enumerated as (2) in the foregoing. Additionally, with the decrease of the developing sleeve diameter, the setting of the angle between the regulating blade and the regulating magnetic pole enumerated as (3) becomes difficult.

Furthermore, the decrease of the developing sleeve diameter reduces the power of triboelectric charge application to the toner particles in the developing apparatus because of the decrease of contact area between the toner particles and the sleeve and because of the decrease in the contact area between the toner particles and magnetic particles resulting from the decrease of the magnetic particles which can be retained in the developer container by the magnetic force, due to the decrease of the magnet diameter. This makes further difficult the maintenance of the stabilized state of packing. Those are the difficulties confronted by the inventors.

Still further, looking at the developing position, the area of the developing portion is reduced due to the decrease of the developing sleeve diameter, with the result that the magnetic field strength present there is limited, so that the developing action itself becomes difficult. For this reason, the state of magnetic field in the developing position becomes more influential to the developing action. This is the finding by the inventors, on which the present invention is based.

Even in the case that the sleeve diameter is relatively large, some magnet roll requires to include plural magnetic poles such as a regulating pole, a conveying pole and a developing pole. In that case, the magnet roll has to be designed so as to match the natures for which the respective magnetic poles are provided, and therefore, it is almost impossible to increase the strength and/or the width of the developing pole.

The inventors have revealed the following. When the magnetic force of the developing magnetic pole is weakened, it is difficult to prevent carrier magnetic particles from being deposited onto the photosensitive member. Also, even if the maximum magnetic flux density is comparable, the case where the magnetic pole width is reduced equally at the upstream and downstream sides results in an insufficiency of the magnetic force at the downstream side of the developing portion, so that it is difficult to prevent the carrier particles from being deposited onto the photosensitive member.

Further, where the magnetic pole is deviated toward downstream side to increase the magnetic force at the downstream side as compared with the portion where the gap between the photosensitive member and the developing sleeve is minimum, with respect to movement of the developer, in an attempt to prevent deposition of the carrier particles onto the photosensitive member, the magnetic brush is not sufficiently erected in the developing zone with the result that the toner transfer from the sleeve surface or the carrier particles adjacent the sleeve surface are obstructed, which leads to the decrease of the development efficiency.

The present invention starts from the confrontation against the problems described above, and the inventors note particularly the magnetic flux density distribution provided by the magnetic pole of the magnetic field generating means contained in the developing sleeve functioning as a developer carrier member. The resultant invention is applicable not only to a small diameter developing sleeve but also to a usual or a larger diameter developing sleeve.

SUMMARY OF THE INVENTION

Accordingly, it is a principal object of the present invention to provide a developing apparatus and an image forming apparatus wherein the density of the magnetic particles ruling the surface state of the developer layer can be made uniform in the direction of movement of the developer layer and in the direction perpendicular thereto.

It is another object of the present invention to provide a developing apparatus wherein even if the thickness of the developer layer is so thin as to be not more than 1 mm, the thickness thereof is uniform, and in addition, the magnetic particle content adjacent the surface of the developer layer is uniform so that fine unsmoothness thereof is made uniform to provide a satisfactorily developing action under a wide variety of developing conditions.

It is a further object of the present invention to provide a developing apparatus comprising an improved developer layer regulating means which can supply a developer layer to a developing zone wherein the developer layer is better matched with the alternating electric field formed in the developing zone.

It is a yet further object of the present invention to provide a developing apparatus wherein the behavior of the developer layer can be made uniform in the developing zone where a latent image bearing member and a developer carrying member are opposed and where an alternating electric field is formed, whereby the development efficiency is further increased.

It is a still further object of the present invention to provide a developing apparatus, wherein the magnetic particles supplied from the developer layer to the image bearing member are more effectively collected back to the developer carrying member in that part of the developing zone where the clearance (between the developing sleeve and the photosensitive member) increases.

It is a further object of the present invention to provide a developing apparatus wherein the magnetic particle collecting efficiency is thus increased, and wherein an alternating electric field is formed in the developing zone, in which the developing operation is matched with the latent image so as to provide an excellent image quality without foggy background.

It is a further object of the present invention to provide a developing apparatus which can accomplish a plurality of the above described objects.

According to an embodiment of the present invention, there is provided a developing apparatus for developing a latent image using a developer containing magnetic particles and toner particles in a developing zone including a developer container for accommodating the developer containing the toner particles and magnetic particles, a developer carrying member for carrying thereon the developer from the container to the developing zone, said developer carrying member being opposed to a latent image bearing member for bearing the latent image to be developed to form the developing zone for supplying the toner particles to the latent image bearing member; an alternating field forming means for forming in the space between the latent image bearing member and the developer carrying member in the developing zone an electric field having an alternatingly changing direction; magnetic field generating means disposed opposed to the developer carrying member at such a side opposite from the side carrying the developer; a member for regulating an amount of the magnetic particles and toner particles applied on the surface of the developer carrying member; wherein said magnetic field generating means has a regulating magnetic pole adjacent an upstream side of the regulating member with respect to movement direction of the developer carrying member, and wherein the magnetic flux density decreases less steeply at the downstream side of the regulating magnetic pole than at the upstream side thereof; and wherein said magnetic field generating means has a development magnetic pole actable to the developing zone; and wherein the magnetic flux density of the development magnetic pole increases more steeply at the upstream side of the development magnetic pole than at the downstream side with respect to the movement direction of the developer carrying member.

Practically, however, the development magnetic pole and the alternating electric field generating means can be omitted from the above structure, or the regulating magnetic pole may be omitted from the above structure, with which the advantages of the present invention can be sufficiently used.

In the embodiment summarized above, the state of the surface of the regulated developer layer is made uniform by the uniform distribution or dispersion of the magnetic particles, so that the uniform developing action can be provided in the developing zone and that the enhancement of the development efficiency by the alternating electric field is further made uniform and better. In addition, the function of the development magnetic pole is effective to abruptly erect the uniform developer layer, by which the initial supply of the developer by the alternating electric field is further enhanced, and an unnecessary development action by the toner particles can be prevented with certainty, so that the carrier particles and magnetic particles can be assuredly collected back into the container. Therefore, the development operation can be stabilized for a long period.

For the better understanding of the present invention, the following is a summary of the functions of the regulating magnetic pole and the developing magnetic pole:

A. with respect to the magnetic flux density on the surface of the developer carrying member provided by the regulating magnetic pole:

A-a. a steep increase at the upstream side provides:

(1) abrupt erection of the developer layer, and therefore, an easy regulation by decreasing the density of the developer:

(2) prevention of clogging of the developer layer in the regulating zone:

(3) better circulation of the developer: and

A-b. a less steep increase at the downstream side provides:

(1) prevention of the toner scattering:

(2) a thin layer with high density having a uniform surface:

B. with respect to the magnetic flux density on the surface of the developer carrying member provided by the developing magnetic pole:

B-a. a steep increase at the upstream side provides:

(1) an increase in the developer supplying function under the presence of an alternating electric field, a better contribution, to the development action, of the toner particles on the surface of the developer carrying member and the toner particles deposited on the carrier particles adjacent the developer carrying member surface by releasing or exposing the surface of the developer carrying member, particularly when the volumetric ratio of the magnetic carrier particles in the developing zone is 1.5–30%:

(2) a developer supply to the latent image bearing member which is uniform in the longitudinal direction due to the uniform and initial erection of the developer layer, and therefore, the uniform development substantially independently from a developing bias:

B-b. a less steep increase at the downstream side provides:

(1) stabilization of collecting of the magnetic carrier particles, and therefore, an increase of the carrier content to make uniform the fog removing function by the carrier particles:

(2) an improvement in the image balance by optimization with the latent image.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
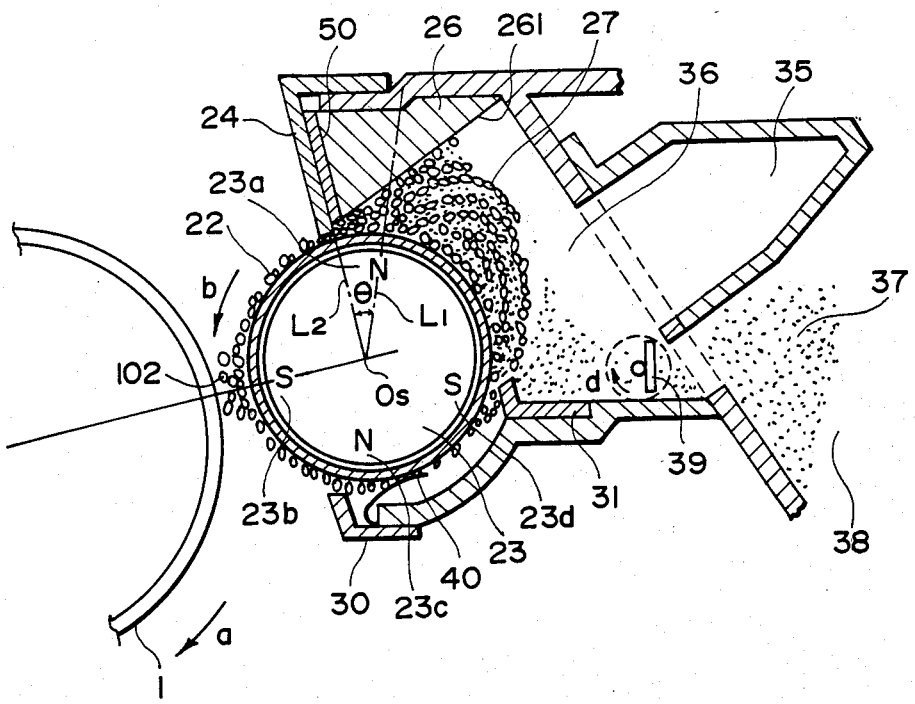
FIG. 2 is a schematic sectional view of a developing apparatus according to the embodiment of the present invention.

Referring first to FIG. 2, there is shown a developing apparatus in a cross section according to an embodiment of the present invention. Designated by a reference numeral 1 is a latent image bearing member such as an insulative drum for electrostatic recording and a photosensitive drum or belt having a photoconductive insulative layer such as an amorphous selenium, CdS, $ZnO_2$, OPC (organic photoconductor) and an amorphous silicon. The latent image bearing member 1 is rotated in a direction indicated by an arrow a by an unshown driving mechanism, during which an electrostatic latent image is formed by a well-known image forming means. To the latent image bearing member 1, a developing sleeve 22 is disposed opposed to or in contact to the latent image bearing member 1. The developing sleeve 2 is made of a non-magnetic material such as aluminum and stainless steel (SUS) 316. The developing sleeve 22 is supported for rotation in the direction indicated by an arrow b with its substantially a half periphery (right) being contained in a developer container 36 and with its remaining half (left) periphery being exposed to the outside through an opening formed in the bottom left portion of a wall of the developer container.

A stationary permanent magnet 23 is contained in the developing sleeve 22, and it functions to generate a stationary magnetic field. In this embodiment, the magnet 23 is not rotated even when the developing sleeve 22 is rotated. The magnet 23 has a north pole **23*a*, a south pole 23*b*, a north pole 23*c* and a south pole 23*d* (four magnetic poles), in this embodiment. The magnet 23** is shown as a permanent magnet, but it may be an electromagnet.

A non-magnetic blade 24 has a base portion which is fixed to a wall of the container 36 above the top edge of the opening in which the developing sleeve 22 is disposed, and it has a free bottom edge which is projected into the opening of the container 36 adjacent the upper edge of the opening. The blade is made of a non-magnetic material and is extended along the length of the opening to function as a developer regulating member. It may be a plate made of SUS 316 or the like bent into an L shape.

A magnetic particle limiting member 26 has a top surface contacted to the bottom surface of the non-magnetic blade 24 and a front surface functioning as a developer guiding surface 261.

The magnetic particles are designated by a reference numeral 27 and have a particle size (diameter) of 30–100 microns, preferably 40–80 microns and a resistance of not less than $10^7$ ohm.cm, preferably not less than $10^8$ ohm.cm. The magnetic particles are made of ferrite particles (maximum magnetization 60 emu/g) coated with resin. The non-magnetic developer (toner) is designated by a reference 37.

A magnetic member 31 is mounted to an inside surface of the developer container 36 at a lower portion thereof and is opposed to the developing sleeve 22 in order to prevent leakage of the magnetic particles 27 and the non-magnetic toner particles 37 from the developer container 36 below the developing sleeve 22. The magnetic member 31 is made of, for example a plated ion plate. A magnetic field formed between the magnetic member 31 and the south magnetic pole **23*d* is effective to provide a sealing effect for preventing the leakage while allowing the magnetic particles 27 to return into the container 36 on the sleeve 22**.

A toner supplying member 39 functions to supply the toner particles into the magnetic brush of the magnetic particles formed by the stationary magnetic pole 23 in the developing sleeve 22. The toner supplying member 39 is of a metal plate coated with a rubber sheet rotatably supported and conveys the toner as if it sweeps the bottom surface of the container 36. To the toner supplying member 39, the toner is supplied by an unshown toner conveying member provided in the toner container 38.

The magnetic particles have been contained in the magnetic particle container 35.

Adjacent the bottom of the developer container 39, there is provided a sealing member 40 for sealing the toner stagnating at the bottom portion of the developer container 36. The sealing member 40 is flexible and is bent along the rotational direction of the sleeve 22 to be resiliently urged to the surface of the sleeve 22. The sealing member 40 has an edge at a downstream side of the contact area therebetween with respect to the rotational direction of the sleeve to allow the developer to return into the container 36.

A scatter preventing electrode plate 30 is supplied with a voltage having a polarity which is the same as that of floating developer produced by the developing operation to urge the floating developer to the photosensitive member 1 to prevent the floating developer from being scattered.

The south pole **23*d* generates a magnetic field between itself and a magnetic member 31 to provide a magnetic seal. Only a part of the magnetic member 31 is opposed to the magnetic pole 23*d*. The magnetic member 31 is disposed at a bottom portion of the developer container 36 at a substantial end of the developer accommodating portion of the developer container 36. Adjacent this end portion, the movement of the returned magnetic carrier particles is effective to incorporate the toner particles adjacent the bottom of the container 36 into the developer on the surface of the sleeve 22**. Therefore, the stabilized collection of the magnetic particles leads to the stabilized developing operation.

The magnetic member 31 has a generally L shaped cross section. The magnetic member 31 may be produced by bending a not permanently magnetized steel plate or a non-magnetized steel plate into this shape, the bending making it weakly magnetized. When a magnet is used as the magnetic member 31, the surface 66 has to be magnetized to a polarity opposite to the polarity of the magnetic pole **23*d***, more particularly, it has to be magnetized to a north polarity in this embodiment.

Thus, the magnetic member 31 functions to confine the magnetic particles so as to prevent loss of the magnetic particles and also functions to allow easy returning of the magnetic particles into the container 36. Therefore, the toner particles are effectively prevented from leaking out of the developer container 36.

Further, by disposing the magnetic pole **23*d* in the manner described above, an additional advantage can be provided in connection with the magnetic pole 23*a*. Due to the above described relationship between the bottom of the developer containing portion of the container 36 and the magnetic pole 23*d***, the magnetic brush is not formed with a smaller density as compared with the state of stagnation, and therefore, the toner particles are not excessively taken into the magnetic brush of the magnetic particles. This is advantageous because if the toner is excessively taken by the magnetic brush, the charge of the toner becomes insufficient with the result of formation of a foggy background.

This structure is effective when the developer container contains magnetic particles and non-magnetic or weakly magnetic toner particles.

The inventors' experiments have shown that when the clearance between the developing sleeve 22 and the magnetic member 31 is 2.5 mm, the magnetic carrier particles are completely returned into the container 36, whereas the toner particles are completely prevented from leaking, and therefore, a stabilized developing operation can be achieved. It is considered that the existence of the surface 66 is effective to properly disperse the magnetic force provided by the magnetic pole **23*d***, so that the magnetic force in this region is substantially enhanced to increase the magnetic sealing effect.

The distance $d_2$ between the non-magnetic blade 24 end and the developing sleeve 22 is 50–800 microns, preferably 150–500 microns. If the clearance is smaller than 50 microns, the magnetic particles are more easily clogged in the clearance, resulting in formation of a non-uniform developer layer, and it becomes not possible to apply on the sleeve 22 sufficient amount of developer to perform a good developing operation, and therefore, a developed image having a lower density and having non-uniformness results. If, on the contrary, it is larger than 800 microns, the amount of the developer layer on the developing sleeve 22 increases so that a desired regulation of the developer layer thickness can not be expected. This results in a larger amount of the magnetic particles deposited onto the latent image bearing member, and the circulation of the developer which will be described hereinafter and the developer limiting action by the developer limiting member 26 are weakened, with the result of insufficient triboelectric charge being applied to the toner, which leads to production of a foggy background.

A magnetic particle layer is formed adjacent the sleeve 22 surface by the attraction force provided by magnetic poles of the magnetic field generating means 23. The magnetic particle layer is moved, when the sleeve 22 is rotated in the direction b, by the balance between the confining force provided by the magnetic force and by the gravity force and the conveying force provided by the movement of the sleeve 22. However, the movement of the developer particle layer becomes slow with a distance from the surface of the sleeve 22 to form a stationary layer at an outside portion of the magnetic particle layer, which is substantially stationary although slightly movable. Some part thereof falls by the influence of the gravity.

Therefore, by property selecting the positions of the magnetic poles **23*a* and 23*d*, the fluidability of the magnetic particles 27 and a magnetic property thereof, a movable magnetic particle layer is formed adjacent the surface of the sleeve 22, which is moved toward the magnetic pole 23*a*. The movable layer takes thereinto the toner from the toner layer outside the magnetic particle layer. The toner is triboelectrically charged by the friction of the magnetic particles and the surface of the sleeve 22, and the triboelectrically charged toner is conveyed to the developing zone by the rotation of the sleeve 22** and is used for the developing operation.

The movement of the magnetic particle layer is determined by the fluidability of the developer and the magnetic force thereto, and when the toner content is low in the magnetic powder, the stationary layer is small, so that most of the magnetic particles in the magnetic particle layer move quickly and take the toner particles from the toner layer into among them. When the toner content is high, the stationary layer becomes larger, so that the movable part of the magnetic particle layer is almost covered by the stationary layer and becomes unable to contact the toner layer so that the toner is hardly taken thereinto. In this manner, the toner content is substantially maintained naturally.

Now, the description will be made with respect to the magnetic particle layer adjacent the non-magnetic blade 24 and adjacent the circulation limiting member 26. The limiting member 26 functions not only to mechanically prevent unnecessary toner from going into the developer regulating zone. In the regulating zone defined by the limiting member 26 and the sleeve 22, the magnetic particles conveyed by the rotation of the sleeve 22 and the function of the magnetic pole **24*a* are packed along a guiding surface 261 of the limiting member 26 so that the density of the magnetic particles there is increased. In this zone, the magnetic particles newly introduced by the conveyance and the magnetic particles discharged under the blade 24 are dynamically exchanged, and therefore, the magnetic particles collide to produce a stirred state, although a substantially packed state is formed. By this, the toner particles are triboelectrically charged by contact with the magnetic particles and/or the surface of the sleeve 22, and the toner particles which are insufficiently charged and therefore are deposited with weaker force to the magnetic particles and/or the surface of the sleeve 22 are released from the magnetic particles and/or the surface of the sleeve 22. In other words, the selection of the toner or the improvement in the charging of the toner are performed, in effect. Therefore, it becomes possible to provide the toner which has been sufficiently charged triboelectrically to the developing zone. Also, the non-uniformness of the magnetic particles during the conveyance is made uniform in the regulating zone, so that the magnetic particles are formed into a uniform and stabilized magnetic particle layer applied on the surface of the sleeve 22. Therefore, it is important that the limiting member 26 is provided with the guiding surface 261, and the inclination of the surface 261** and the volume of the regulating zone or space are influential to the state of the magnetic particle packing state in this zone.

The magnetic pole **23*a* stationarily disposed in association with this zone is effective to relocated the packed magnetic particles along the magnetic line of force. The packing state in this zone is influential to the triboelectric charge application to the toner, and therefore, it is desirable that a constant packing state is maintained to stabilize the triboelectric charge application. Since the magnetic pole 23*a* is effective to form a magnetic brush with a force substantially perpendicular to the tangential direction on the sleeve along which the magnetic particles have been conveyed, the magnetic powder is loosened in addition to being stirred, so that the uniformization and the stabilization of the triboelectric charge application to the toner and the formation of the magnetic particle layer on the sleeve are further promoted. At this time, if the packed developer is maintained under a high pressure, the developer is clogged too much, which is a problem. However, by opposing the position of the maximum magnetic force provided by the magnetic pole 23*a* to the guiding surface 261**, an excessive pressure concentration is prevented in the regulating zone, so that the concentration of the developer and the high content of the magnetic particles can be maintained under an appropriate state.

Accordingly, the regulating zone described above provides a thin developer layer on the sleeve 22 with a stabilized amount of the magnetic particles and sufficiently charged toner particles. Thus, the developing action in the developing zone 102 is stabilized. It has been confirmed that the above described regulating zone is effective particularly in the developing method and apparatus wherein at the developing zone, an alternating electric field sufficient to transfer onto the electrostatic latent image bearing member at least the toner particles carried on the surface of the developer carrying member surface among the toner particles introduced into the developing zone, and wherein a volumetric ratio of the total volume of the magnetic particles existing at the developing position to a volume of space defined by the surface of the electrostatic latent image bearing member and the developer carrying member at the developing position is 1.5–30%.

In the structure of FIG. 2, a magnetic member 50 is mounted to a non-magnetic blade side of the developer limiting member 26. In this case, it is not preferable to dispose the magnetic member 50 in opposition to the magnetic pole **23*a*, since then a strong magnetic field concentration is produced between itself and the magnetic pole 23*a* with the result that the stirring and loosening actions by the magnetic pole 23*a* on the magnetic powder are decreased. However, it is effective to provide the magnetic member 50 in the regulating zone to magnetically confine the magnetic particles between the magnetic member 50 and the magnet 23 in the sleeve 22, since then the tolerable error in the clearance between the regulating member 24 edge and the sleeve 22** surface can be increased. As compared with the toner particles deposited on the magnetic particles, the toner particles deposited on the sleeve 22 have a smaller amount of charge than those on the magnetic particles. This is because the magnetic particles are conveyed together with movement of the sleeve 22, whereby the opportunity of the toner particles on the sleeve 22 being frictioned with the magnetic particles is small. In order to raise the degree of being charged of the toner on the sleeve 22, it is desirable to positively friction the toner on the sleeve 22. To accomplish this, it is preferable that magnetic particles exist in the neighborhood of the surface of the sleeve 22, which magnetic particles are moved relative to the moving sleeve 22.

However, simply reducing the conveyance property of the magnetic particles is not practically possible, if the above described toner introducing function is to the maintained. Likewise, disposing a magnetic member opposed to the magnetic pole 23*a* in the regulating zone in an attempt to increase the friction of the magnetic particles with the surface of the sleeve 22 results in decrease of the above-described advantage provided by the maximum magnetic force generating portion being opposed to the space defined by the developer circulation limiting member 26.

In consideration of those factors, in the developing apparatus of this embodiment, the magnetic member 50 is disposed opposed to a downstream side of the magnetic pole 23*a* with respect to movement direction of the sleeve 22, so as to substantially concentrate the magnetic lines of force at the blade side provided by the magnetic pole 23*a* in the tangential direction of the surface of the sleeve 22. By doing so, only the magnetic particles that are present in the neighborhood of the surface of the sleeve 22 are formed into a magnetic brush along the surface of the sleeve 22, whereby it frictions with the toner particles on the sleeve 22, thus enhancing the triboelectric charge application to the toner particles on the sleeve 22.

The description will be made as to the magnetic flux density distribution provided by the magnetic pole 23*a*. The developing apparatus of this embodiment is not equipped with an automatic toner supplying device for the purpose of maintaining a proper toner content. In such a developing action, the maximum magnetic flux density of the magnetic pole 23*a* is preferably not less than 800 Gausses from the standpoint of stabilizing the developer application on the sleeve 22 against the possibility of the change in the toner content of the magnetic particle layer. Additionally, from the standpoint of providing a better latitude by increasing the tolerable error in the mechanical accuracy in the clearance between the blade 24 edge and the sleeve 22 surface, and from the standpoint of stabilizing the packing state of the magnetic particles in the regulating zone, the magnetic flux density at the point where the blade 24 edge is opposed is preferable not less than 600 Gausses. It has been found that it is difficult to satisfy both of those requirements when the diameter of the magnet is decreased.

More particularly, if the maximum magnetic flux density is made not less than 800 Gausses, it is difficult to obtain a wide magnetization width providing the magnetic flux density not less than 600 Gausses. For example, when the magnetic flux density distribution is symmetrical with the center of the regulating magnetic pole 23*a*, and when the magnetic flux density at the point opposed to the blade edge is made not less than 600 Gausses, the angle $\theta$ formed between the line L1 and the line L2 has to be decreased, which leads to degrading the effects of the guiding surface 261 of the limiting member 26 and the magnetic member 50. Also, the angle $a_1$ is preferably small. If the angle $a_2$ is large, the size of the magnetic brush of the magnetic particle layer on the sleeve 22 becomes large with the result of taking an excessive amount of toner particles to excessively increase the toner content in the developer particle layer which leads to production of a foggy background.

Figure 1:
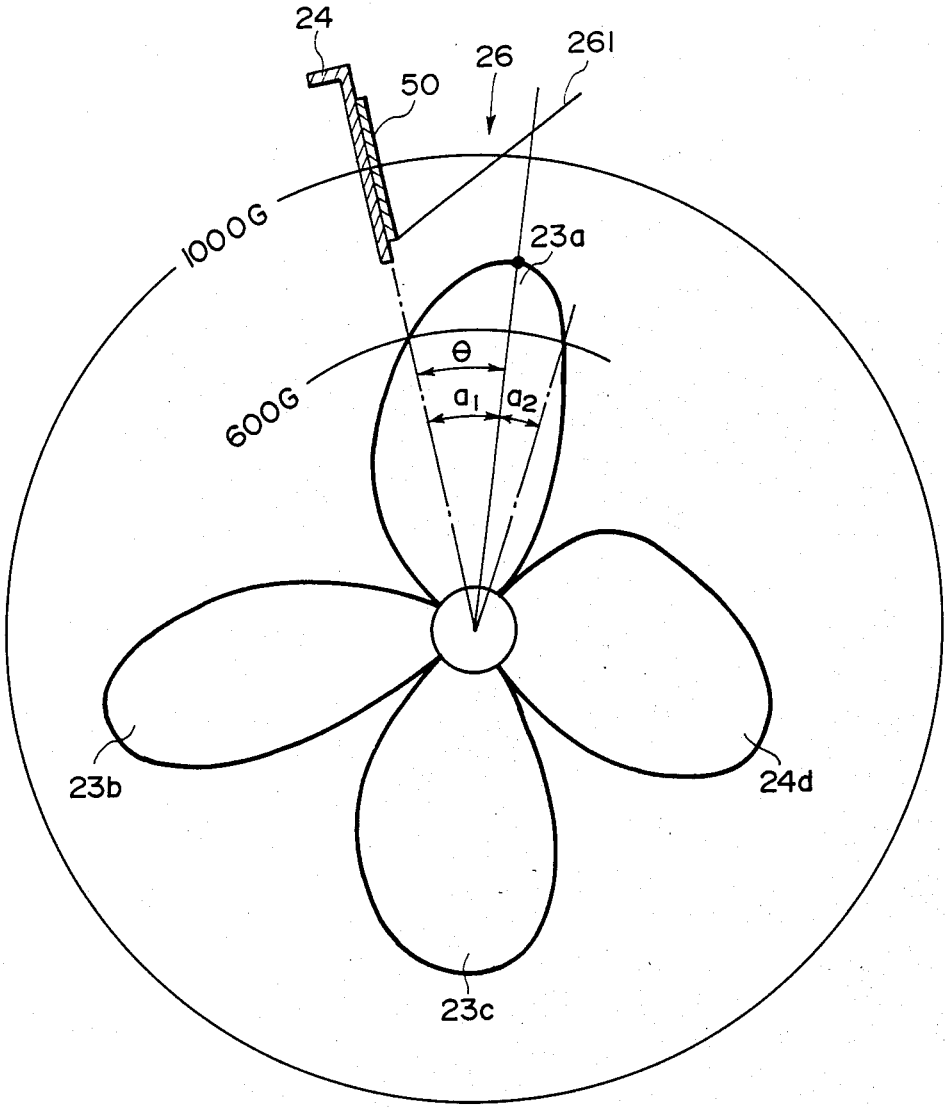
FIG. 1 shows a magnetic flux density distribution of a magnet used with a developing apparatus according to an embodiment of the present invention.

Referring to FIG. 1, there is shown a magnetic flux density distribution provided by the magnet 23 in this embodiment which utilizes a small diameter sleeve 22 (16 mm). In this Figure, a first line is drawn between the center of the magnet 23 and the point of the maximum magnetic force provided by the magnetic pole 23*a*. Second and third lines are drawn between the center of the magnet and the points of the magnetic flux density of 600 Gausses upstream and downstream of the magnetic pole 23*a*, respectively with respect to of the movement direction of the sleeve 22. The angles $a_2$ and $a_1$ preferably satisfy $a_1 \geqq \theta$ and $a_1 > a_2$.

By this, the magnetic flux density in the downstream side decreases less steeply, whereby the magnetic flux density at a position opposed to the edge of the blade 24 can be not less than 600 Gausses to effectively use the magnetic pole 23*a* without degrading the effects of the magnetic member 50 and the guiding surface 261.

The developing pole 23*a* is disposed substantially opposed to the developing zone, and the magnetic flux density thereby is preferably not less than 800 Gausses in order to prevent deposition of the magnetic particles to the latent image.

According to this embodiment, a high quality image can be provided, and it is usable with a small size apparatus such as a disposable apparatus.

A toner container 38 is formed horizontally adjacent to the developer container 36. The toner container 38 is equipped with a toner conveying member for conveying the toner into the developer container 36.

The magnetic pole 23*c* serves to collect the developer after the developing position and is disposed upstream of the edge of the magnetic seal 31 with respect to movement of the developing sleeve 22. If, it is disposed downstream, chains of magnetic particles are erected by the magnetic pole 23*c* in the neighborhood of the toner receiving opening adjacent the bottom of the developer container 36, with the result that the toner particles are extremely easily taken into the magnetic powder so that the triboelectric charge to the toner becomes insufficient, which leads to production of the foggy background.

Now, the description will be made with respect to the volumetric ratio of the magnetic particles at the developing station. The "developing position" or "developing zone" is defined as the region in which the toner particles are transferred or supplied from the sleeve 22 to the photosensitive drum 1. The "volumetric ratio" is the percentage of the volume occupied by the magnetic particles present in the developing position or zone to the entire volume of the developing position or zone. The volumetric ratio is significantly influential in this developing apparatus, more particularly, it is preferable that the volumetric ratio is 1.5–30%, more preferably 2.6–26%.

If this is smaller than 1.5%, the problems have been confirmed that the image density of the developed image is too low; that a ghost image appears in the developed image; a remarkable density difference occurs between the position where the chain 51 exists and the position where no chain exists; and or that the thickness of the developer layer formed on the sleeve 22 is not uniform.

If the volumetric ratio is larger than 30%, the surface of the sleeve is closed, that is, covered by the magnetic particles too much, and a foggy background results.

It should be appreciated that the image quality does not monotonously become better or worse with the increase or decrease of the volumetric ratio; that the satisfactory image density can be obtained within the range of 1.5–30% of the volumetric ratio; the deterioration of the image is recognized both below 1.5% and beyond 30% of the volumetric ratio; and that in this satisfactory range, neither the ghost image nor the foggy background results. The image deterioration resulting when the volumetric ratio is low is considered as being caused by the negative property, while the deterioration when the volumetric ratio is too large is considered as being caused by the closed or covered sleeve surface resulting from the large amount of the magnetic particles, thus reducing too much the toner supply from the sleeve surface.

If the volumetric ratio is less than 1.5%, the image reproducibility of a line image is not satisfactory with a remarkable decrease of the image density. If it is more than 30%, the magnetic particles can physically damage the surface of the photosensitive drum 1, and the toner particles can be kept deposited on the photosensitive drum as a part of the developed image, which is a problem at the subsequent image transfer or image fixing station.

In the region where the volumetric ratio is near 1.5%, a locally non-uniform development can occur (under particular conditions) when a large area solid black image is developed. For this reason, the volumetric ratio is determined such that this does not occur. For this purpose, it is more preferable that the volumetric ratio is not less than 2.6%, and therefore, this defines a further preferable range.

Figure 3:
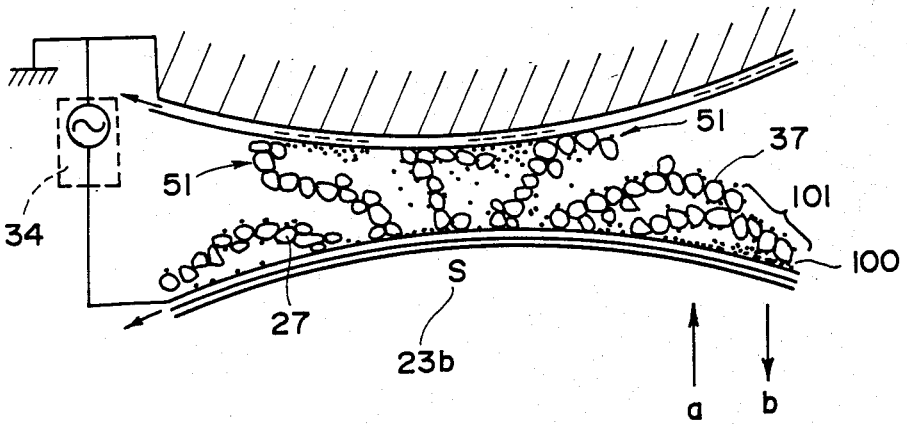
FIG. 3 is a sectional view of the developing apparatus according to this embodiment wherein the behavior of the magnetic and toner particles are shown.

If the volumetric ratio is near 30%, the toner supply from the sleeve surface can be delayed in such a region adjacent the positions where the chains of the magnetic particles are contacted, for example, when the developing speed is high. If this occurs, a non-uniform developed image can result in the form of scales in the case of solid black image reproduction. In order to assure the prevention of this, the volumetric ratio is preferably not more than 26%.

Where the volumetric ratio is in the range of 1.5–30% (4% in this embodiment), the chains 51 of the magnetic particles are formed on the sleeve surface and are distributed sparsely to a satisfactory extent, as shown in FIG. 3, so that the toner particles on the chain surfaces and those on the sleeve surfaces are sufficiently opened toward the photosensitive drum 1, and the toner particles 100 on the sleeve 22 are transferred by the alternating electric field. Thus, almost all of the toner particles are consumable for the purpose of development. Accordingly, the development efficiency (the ratio of the toner consumable for the development to the overall toner present in the developing position), and also a high image density can be provided. Preferably, the fine but violent vibration of the chains is produced, by which the toner powder 100 deposited on the magnetic particles and the sleeve surface are sufficiently loosened. In any case, the trace of brushing or occurrence of the ghost image as in the magnetic brush development can be prevented. Additionally, the vibration of the chains enhances the frictional contact between the magnetic particles 27 and the toner particles 37, with the result of the increased triboelectric charging to the toner particles 37, by which the occurrence of the foggy background can be prevented. Also, the high development efficiency is suitable to the reduction of the size of the developing apparatus.

The volumetric ratio of the magnetic particles in the developing position is determined;

$$(M/h)\times(1/\rho)\times[C/(T+C)]$$

where

M is the weight of the developer (the mixture) per unit area of the sleeve surface when the erected chains are not formed ($g/cm^2$);

h is the height of the space of the developing position (cm);

$\rho$ is the true density ($g/cm^3$);

C/(T+C) is the percentage of the magnetic (carrier) particles in the developer on the sleeve.

The percentage of the toner particles to the magnetic particles at the developing position as defined above is preferably 4–40% by weight.

In this embodiment, the alternating electric field is strong enough (large rate of change or large Vpp), the chains are released from the sleeve 22 surface or from their base portions, and the released magnetic particles 27 also reciprocate between the sleeve 22 and the photosensitive drum 1. Since the energy of the reciprocal movement of the magnetic particles is large, the above described effect of the vibration are further enhanced.

The above described behavior has been confirmed by a high speed camera available from Hitachi Seisakusho, Japan operable at the speed of 8000 frames/sec.

Even in the case where the clearance is reduced between the photosensitive drum 1 surface and the sleeve 22 surface so as to increase the contact pressure between the photosensitive drum 1 and the magnetic particle chains and to decrease the vibration, the clearance is still large enough at the inlet and outlet sides of the developing position, and therefore, the vibration is sufficient with the above described advantages.

On the contrary, if the clearance is increased, it is preferable that the magnetic particle chains 51 are contacted to the drum 1 surface when the magnetic field is applied, even if they do not contact the drum surface without the electric field.

A developing apparatus was constructed according to this embodiment, as shown in FIG. 2. As for the sleeve 22, an aluminum sleeve having the diameter of 16 mm was used after the surface thereof was treated by irregular sand-blasting with ALUNDUM abrasive. Within the sleeve 22, the magnet 23 magnetized with four poles was used, the N and S poles being arranged alternately along the circumference as shown in FIG. 1. The maximum surface magnetic flux density by the magnet 23 was approximately 800 Gauss.

The blade 24 used had the thickness of 1.2 mm made of non-magnetic stainless steel. The angle $\theta$ was set 15 degrees. The angles $a_1$ and $a_2$ were 15 and 10 degrees, respectively.

As for the magnetic particles, ferrite particles (maximum magnetization of 60 emu/g) had the particle size of 70–50 microns (250/300 mesh), whose surface was treated by silicon resin.

As for the non-magnetic toner, blue powder provided by a mixture of 100 parts of styrene/butadiene copolymer resin and 5 parts of copper phthalocyanine pigments, and added by 0.6% of the colloidal silica, was used. The average particle size of the toner particles was 10 microns. Upon operation, approximately 10–30 microns thickness of the toner layer was obtained on the sleeve 22 surface, and above the toner layer, the magnetic particle layer of 200–300 microns thickness was formed. On the surfaces of the magnetic particles, there were toner particles.

At that time, the total weight of the magnetic particles and the toner particles on the sleeve 22 was approximately $2.43\times10^{-2}$ g/cm$^2$.

The weight ratio of the toner particles deposited on the magnetic particles and the toner particles deposited on the sleeve was approximately 2:1.

The magnetic particles were formed into erected chains at and adjacent the developing position by the magnetic pole **23*b* within the sleeve 22**. The maximum height of the chains was approximately 1.2 mm.

The amount of electric charge was measured by a blow-off method, and the triboelectric charge of the toner particles on the sleeve 22 and the magnetic particles was +12 mC/g.

The developing apparatus was assembled into a commercial copying machine, FC-5 sold by Canon Kabushiki Kaisha, Japan. The clearance between the surface of the photosensitive drum 3 made of organic photoconductor material and the surface of the sleeve 22 was set 350 microns. The volumetric ratio under those conditions was approximately 10% ($h=350$ microns, $M=2.43\times10^{-2}$ g/cm$^2$, $\rho=5.5$ g/cm$^3$, $C/(T+C)=20.4\%$). The bias voltage source 4 provided an alternating voltage having the frequency of 1800 Hz, wherein an alternating voltage having the peak-to-peak value of 1200 V was superimposed with a DC voltage of −270 V. When this was operated, good blue images were obtained.

The developing operation was performed to obtain a solid image, and then the surface of the sleeve 22 was carefully observed after the developing operation. It was confirmed that almost all of the toner particles on the sleeve and on the magnetic particles were consumed up, and therefore, the developing operation was effected with almost 100% development efficiency.

It was confirmed that the development properties were good enough without foggy background.

As regards the magnetic member 31, good introduction of the magnetic particles, good prevention of leakage and good circulation have been confirmed.

As described in the foregoing, the present embodiment is advantageous in the high image density, high development efficiency, no foggy background, no ghost image, no trace of brushing and no negative property.

Usable materials for the sleeve 22 are conductive material such as aluminum, brass and stainless steel and a cylinder of paper or synthetic resin. By processing the surface of those cylinders with conductive material, or by constituting the surface by a conductive material, it can serve as a developing electrode. As an alternative, a core roller is used which is wrapped by a conductive and elastic member, for example, a conductive sponge.

As regards the magnetic pole **23*b*** at the developing position, it is disposed at the center of the developing station in the direction of the movement of the surfaces of the photosensitive member and the sleeve. However, it may be deviated from the center, or the developing position may be disposed between magnetic poles.

To the toner powder, silica particles may be added to enhance the flowability, or abrasive particles or the like may be added to abrade the surface of the photosensitive drum 1 (latent image bearing member) in an image transfer type image forming apparatus. To the toner powder, a small amount of magnetic particles may be added. Magnetic particles may be used if the magnetic property thereof is very weak as compared with that of the magnetic particles and is triboelectrically chargeable.

In order to prevent the occurrence of the ghost image, the developer layer remaining on the sleeve 22 after the developing action may be once scraped off by scraper means (not shown), and then the scraped sleeve surface of brought into contact to the magnetic particle layer in the container, and then the developer is applied thereon. This is effective to prevent the ghost image.

A mechanism may be added to the developing apparatus, which detects the content of the magnetic particles and the toner particles, and in response to the detection, the toner is automatically supplied.

The developing apparatus according to this embodiment is usable with a disposable developing device which contains as a unit the container 21, the sleeve 22 and the blade 24, although it is applicable to usual developing device which is fixed in an image forming apparatus.

Figure 4:
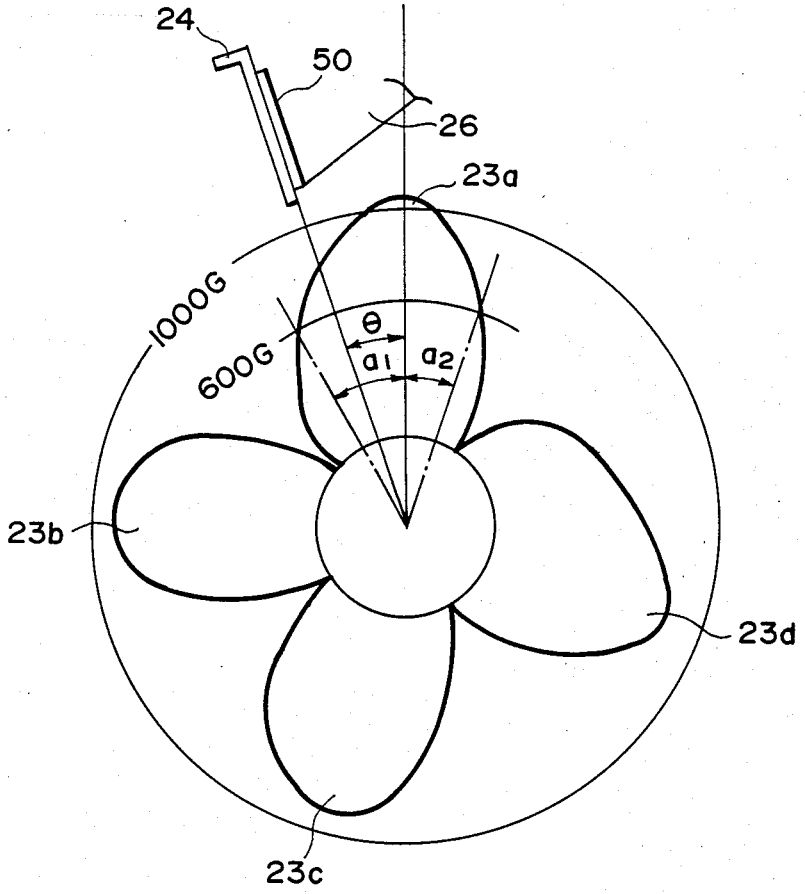
FIG. 4 shows a magnetic flux density distribution of a magnet used with a developing apparatus according to embodiment of the present invention.

Referring to FIG. 4, another embodiment of the present invention will be described. FIG. 2 shows a magnetic flux density distribution provided by the magnet 23 contained in the developing sleeve 22 having the diameter of 20 mm. In the case like this, where the magnet 23 has a relatively large diameter, the above-described requirements in the foregoing embodiment that the maximum magnetic flux density of the magnetic pole **23*a* is not less than 800 Gausses and that the magnetic flux density at a position opposed to the blade 24 is not less than 600 Gausses, can be satisfied without the above-described limitation of $a_1>a_2$. If, however when a magnet 23 with $a_1=a_2$ is used, the magnetic flux density at the point opposed to the blade 24 becomes less than 600 Gausses if the variation during manufacturing in mass production results in the maximum magnetic force point is deviated by several degrees in the upward direction with respect to the rotational direction of the sleeve 22**. In view of this, the requirements $a_1>a_2$ in the foregoing embodiment is effective since it provides such a wide latitude that no problem occurs even if the angle $\theta$ varies during the manufacturing.

As described, according to the structure described above, the power of the magnet can be used efficiently to stabilize the packing state in the regulating zone, so that a developing device capable of providing good quality of image can be provided, irrespective of the size of the magnet as the magnetic field generating means, although the structure is particularly effective to the apparatus using a small diameter sleeve, not more than 20 mm.

Referring to FIGS. 5–10, a further embodiment of the present invention will be described, by which loss of carrier particles can be remarkably reduced, and a high quality image can be produced with high development efficiency.

In this embodiment, a developer mixture containing carrier particles and toner particles is used, and an alternating electric field is formed between a latent image bearing member and a developing sleeve. The developing magnetic pole 23c is disposed opposed to the latent image bearing member, and the magnetic flux density decreases less steeply at the downstream side, whereby the brush of the carrier particles erects sufficiently to provide a desirable developing property, and a sufficient magnetic force can be provided in the downstream side of the developing zone so that the carrier particles are effectively prevented from remaining on the latent image bearing member.

Figure 6:
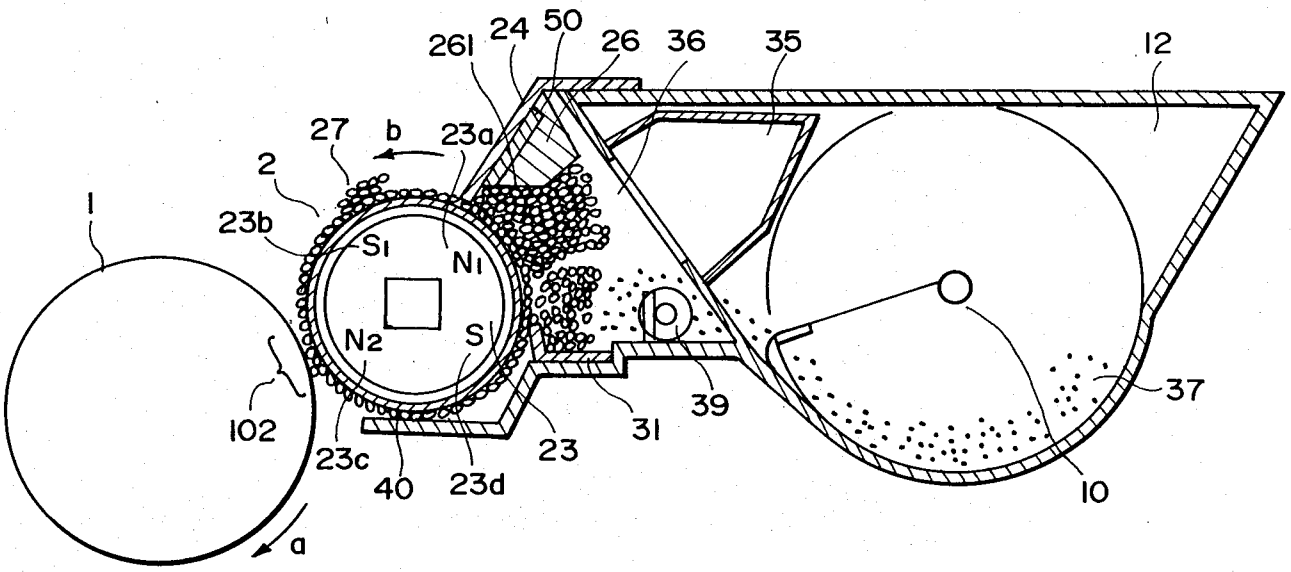
FIG. 6 sectional view of a developing apparatus according to another embodiment of the present invention.

The structure shown in FIG. 6 corresponds to the foregoing embodiment modified in the manner that the magnetic pole 23c is used as a developing magnetic pole 23c, and the developing magnetic pole 23b is disposed between the new developing magnetic pole 23c and the regulating magnetic pole 23a. This embodiment comprises two examples, in one of which the regulating pole 23a does not provide the above described magnetic flux density described with the foregoing embodiment, and in the other of which the regulating pole 23a provides the same magnetic flux density. Since those examples are similar to the foregoing embodiment, except for the portions which will be described, the detailed explanation is omitted for the sake of simplicity by assigning the same reference numerals to the elements having corresponding function.

The developing apparatus according to this embodiment is detachably mountable into an image forming apparatus, more particularly and electrophotographic copying apparatus in this embodiment. In FIG. 6, a toner conveying member 10 in the toner container 12 is shown which has not been shown in the Figures of the foregoing embodiment.

It has been confirmed that this embodiment is also particularly effective to a developing method and apparatus wherein an alternating electric field is formed at a developing station, the alternating electric field being sufficient to transfer to an electrostatic latent image bearing member at least the toner particles carried on the surface of the developer carrying member among the developer conveyed into the developing zone, and wherein a volumetric ratio of the total volume of the magnetic particles existing at the developing position to a volume of space defined by the surface of the electrostatic latent image bearing member and the developer carrying member at the developing position is 1.5–30%.

Figure 5A:
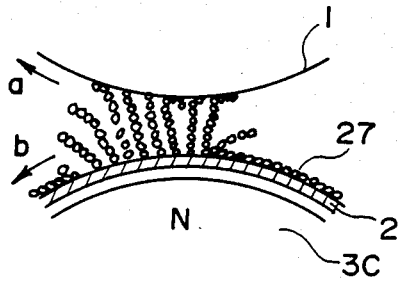
FIGS. 5A and 5B are enlarged sectional view of the developing apparatus.
Figure 5B:
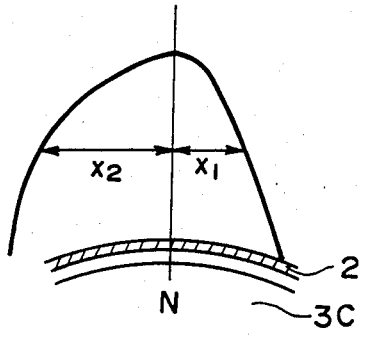

In FIG. 6, the magnetic pole 23c serves as a developing magnetic pole, which provides, as shown in FIG. 5 a maximum magnetic flux density at a point where the developing sleeve 2 is closest to the surface of the photosensitive drum 1, and the magnetic flux density steeply decreases toward the upstream side with respect to the rotational direction of the developing sleeve 2, while it decreases less steeply toward the downstream side. The developer layer conveyed toward the developing zone by the rotation of the developing sleeve 2, is erected abruptly immediately before the developing zone, and is contacted directly to the surface of the photosensitive member. The erection of the developer forms chains of carrier particles 27. By this action, toner particles deposited on the carrier particles 27 are released therefrom, and are easily transferred to the photosensitive member 1. Therefore, the released toner is prevented from being scattered to contaminate the inside of the electrophotographic copying apparatus.

In the developing zone, the developer layer is formed into chains of magnetic particles so that the surface of the sleeve 2 is exposed to promote the transfer of the toner particles from the surface of the developing sleeve 2 and from the carrier particles 27 by the alternating electric field. For this reason, almost all of the toner particles present in the developing zone are used for the development, thus increasing the development efficiency to provide a high quality image.

Since the magnetic force does not substantially lowers at the downstream side, there still exists magnetic force sufficient to transfer the magnetic carrier particles deposited on the photosensitive member 1 back to the developing sleeve 2. To assure this function, it is preferable that not less than 70% of the magnetic force at the closely opposed position is maintained in the downstream side. Also, it is preferable that a width X1 from the maximum magnetic flux density (Gmax) point on the surface of the sleeve 2 to the point where the magnetic flux density is $\frac{1}{2}$ (Gmax) in the upstream side, and a width X2 from the maximum Gmax point to the $\frac{1}{2}$Gmax point in the downstream side satisfy that $X1 < X2$, and $X1:X2 = 1:2$ or larger.

In this manner, good images without carrier particles deposited can be provided with good development property without toner scattering.

According to this embodiment, a high quality image can be provided which is not provided in the conventional developing apparatus, and the developing apparatus is usable in a small side disposable image forming apparatus.

In this embodiment, the regulating pole 23a and the developing pole 23c are spaced with a substantial distance, and therefore, a south pole 23b is disposed therebetween to prevent the developer layer uniformly applied on the developing sleeve 2 by the non-magnetic blade 24 is prevented from being disturbed, so that it functions as a conveying magnetic pole. In order not to disturb the developer layer, the strength of the magnetic pole 23b is preferably equivalent to or slightly smaller than that of the developing electrode 23c.

When the diameter of the developing sleeve 2 is 16 mm, the disturbance of the developer layer on the sleeve 2 is not significant if the angular interval between the regulating pole and the developing pole is not more than 110 degrees as seen from the center of the sleeve 2. If, however, it is larger than 110 degrees, the disturbance of the developer layer is significant, and therefore, it is preferable that a conveying pole is provided between the magnetic poles 23a and 23c.

Figure 7:
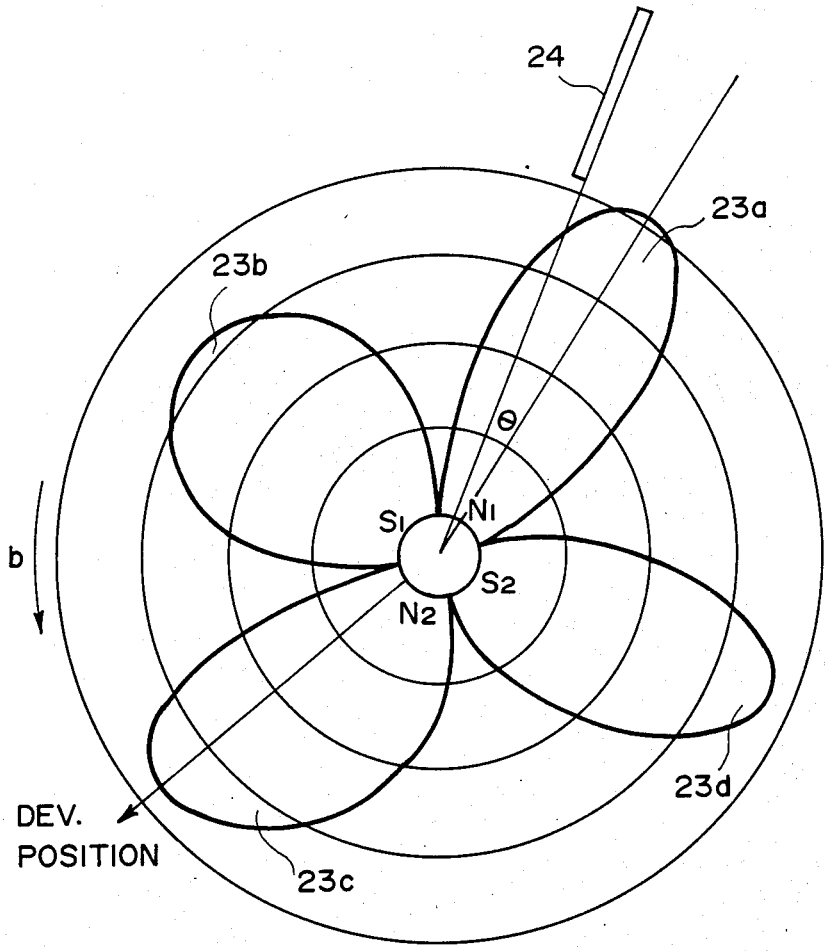
FIG. 7 shows a magnetic flux density distribution of the developing apparatus of FIG. 6.

A developing apparatus was constructed according to this embodiment, as shown in FIG. 6. As for the sleeve 2, an aluminum sleeve having the diameter of 16 mm was used after the surface thereof was treated by irregular sand-blasting with ALUNDUM abrasive. Within the sleeve 2, the magnet 23 magnetized with four poles was used, the north and south poles being arranged alternately along the circumference as shown in FIG. 7. The maximum surface magnetic flux density by the magnet 23 was approximately 900 Gausses.

The developing pole 23c provides the maximum magnetic flux density at a position where the developing pole 23c is opposed to the photosensitive member 1, provides in the upstream side a magnetic force which decreases steeply and provides in the downstream side a magnetic force which decreases less steeply to maintain a sufficient magnetic force outside the developing zone in the downstream side.

The toner powder was added by 1.0% of the silica described with the foregoing embodiment.

The bias voltage source (not shown) provided an alternating voltage having the frequency of 1600 Hz, wherein an alternating voltage having the peak-to-peak value of 1300 V was superimposed with a DC voltage of −300 V. When this was operated in the same manner as with the first embodiment, good blue images were provided. The developing operation was performed to provide a solid image, and then the surface of the sleeve 2 was carefully observed after the developing operation. It was confirmed that almost all of the toner particles on the sleeve and on the magnetic particles were consumed up, and therefore, the developing operation was erected with almost 100% development efficiency.

It was confirmed that the development properties were good enough without foggy background. As described in the foregoing, the present embodiment is advantageous in the high image density, high development efficiency, no foggy background, no ghost image, no trace of brushing and no negative property.

In this embodiment, the developing sleeve 2 has a diameter of 16 mm. However, this invention is applicable to a sleeve having a larger diameter, such as 20 mm or larger.

In this embodiment, the developing magnetic pole **23*c*** is a single pole and provides the magnetic force distribution wherein it attenuates steeply in the upstream side, while it attenuates less steeply in the downstream side. However, it is possible that a pole for enhancing the development efficiency and a pole for collecting the carrier particles are independently provided.

Figure 8A:
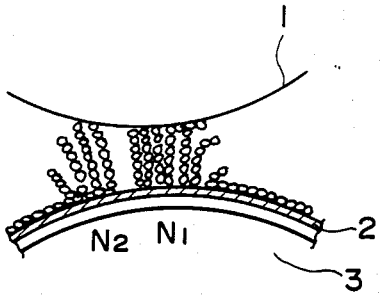
FIGS. 8A and 8B show enlarged sectional views of the developing apparatus according to a further embodiment of the invention.
Figure 8B:
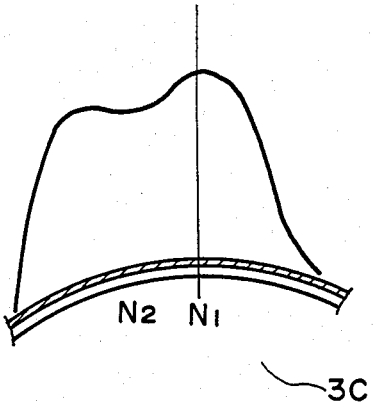

Referring to FIG. 8, there is shown an example of such a developing apparatus. As shown in FIG. 8, the developing magnetic pole **23*c* includes a magnetic pole N1 opposed to the photosensitive drum 1 and a magnetic pole N2 disposed downstream of the developing zone. The polarities of those poles are the same (north), and therefore, they are repelling poles. The magnetic pole N1 functions to completely erect the developer in the developing zone to provide good development properties, and the pole N2 functions to collect the carrier particles from the photosensitive member 1** with certainty.

Because those poles are repelling poles, there exist a portion, between the pole N1 and the pole N2, where the magnetic force is weak. In this portion, the confining force by the magnetic field is not strong, so that the carrier particles are very easily vibrated or transferred by the alternating electric field, whereby the toner particles are easily released from the carrier particles and from the sleeve surface, and the removal of the fog toner from the drum is assured.

Additionally, in this portion, the toner particles are in the form of powder cloud, and therefore, an edge effect of development is promoted. Accordingly, the image having a sharp line and a solid image having a sufficient density can be provided.

Figure 9:
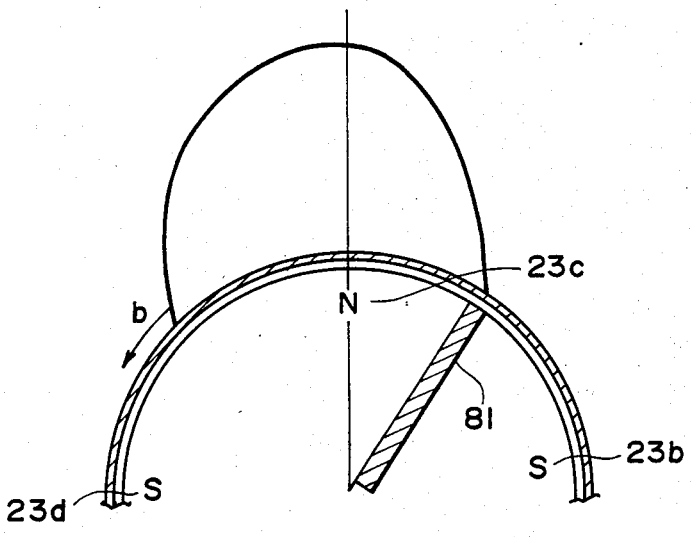
FIG. 9 is an enlarged sectional view of a developing apparatus according to a further embodiment of the present invention.

Referring to FIG. 9, there is shown a further embodiment, wherein a magnetic plate 81 is disposed between the developing magnetic pole **23*c* and an upstream magnetic pole 23*d*, by which the magnetic flux density in the upstream side of the developing magnetic pole 23*c*** is made to steeply attenuate.

By the provision of the magnetic plate 81 as in this embodiment, the magnetic field in the upstream side of the developing zone can be controlled, so that the point where the chain erection of the developer particles can be easily controlled. This prevents the occurrence of erection outside the developing zone. As a result, the toner particles released due to the erecting action are not scattered but can be utilized for the developing operation. Thus, good developing operation without scattering of the toner particles can be accomplished.

The developing pole **23*c* in this embodiment may be in the form of repelling poles shown in FIG. 8**.

Figure 10:
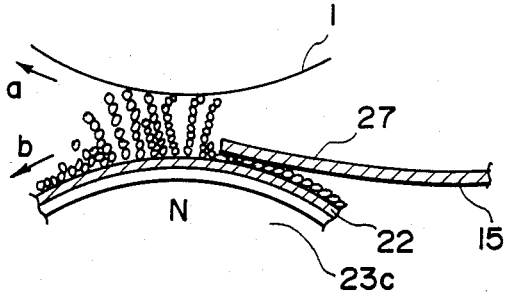
FIG. 10 is an enlarged sectional view of a developing apparatus to a further embodiment of the present invention.

Referring to FIG. 10, there is shown a yet further embodiment wherein a depressing and leveling member 15 for depressing and leveling the magnetic brush is incorporated in the structure described with FIG. 6.

It is preferable to dispose the depressing member 15 adjacent and inclined portion upstream of the developing pole N (not limited to FIG. 6). The depressing member 15 is made of a flexible high polymer material, for example, Myler available from Du Pont having a thickness of 25 microns, and is contacted to the developing sleeve.

By the use of the member 15, the magnetic brush applied on the sleeve can be formed into dense chains in the developing zone. Therefore, the toner particles are easily released from the carrier particles, and the trace of the brushing is not produced on the resultant image. In addition, the carrier particles are effectively retained on the sleeve or attracted to the sleeve by the downstream magnetic force.

Furthermore, the toner particles are prevented from scattering during conveyance from the regulating blade to the developing zone.

As described in the foregoing, according to the present invention, the developer chains are sufficiently erected in the developing zone, and the surface of the developing sleeve is sufficiently exposed, whereby the developing operation is performed efficiently, and the carrier particles are effectively prevented from being deposited on the photosensitive member, and in addition, the toner scattering resulting from the erection of the developer chains is reduced.

According to the present invention, good images can be produced even when a small diameter sleeve is used, such as those having outside diameter of 6–20 mm.

According to this invention, good images can be produced even when a fine toner having a particle size of not more than 10 microns is used.

Referring back to FIG. 6 embodiment, the description will be made as to an example wherein the regulating pole satisfies the requirement of the magnetic flux density distribution as described in conjunction with FIG. 1.

In this example, the function of the regulating pole **23*a* can be used effectively in the developing zone when the conveying magnetic pole 23*b*** is not used. By the steep increase of the magnetic flux density of the developing pole, the regulating pole can provide a surface smoothness, and the magnetic developer layer containing sufficient toner particles is supplied toward the surface of the photosensitive member under a uniform condition. Therefore, the chains of the developer which are uniform in the longitudinal and moving directions of the sleeve. Thus, the non-uniform supply of the developer in the developing operation can be prevented, so that the developed image has a stabilized density. This initial developer supply is significantly influential to the image density of a solid image in its central portion. For this reason, the non-uniform image density can be prevented. In the downstream side continuing from the developing zone, a variation in the developer layer surface is uniform and is stabilized, so that the function of the magnetic particles to remove unnecessary toner particles is stabilized, which leads to stabilized fog prevention and carrier collecting power. It is considered that although the magnetic particles are being conveyed, they function as a stable developing electrode.

Figure 11:
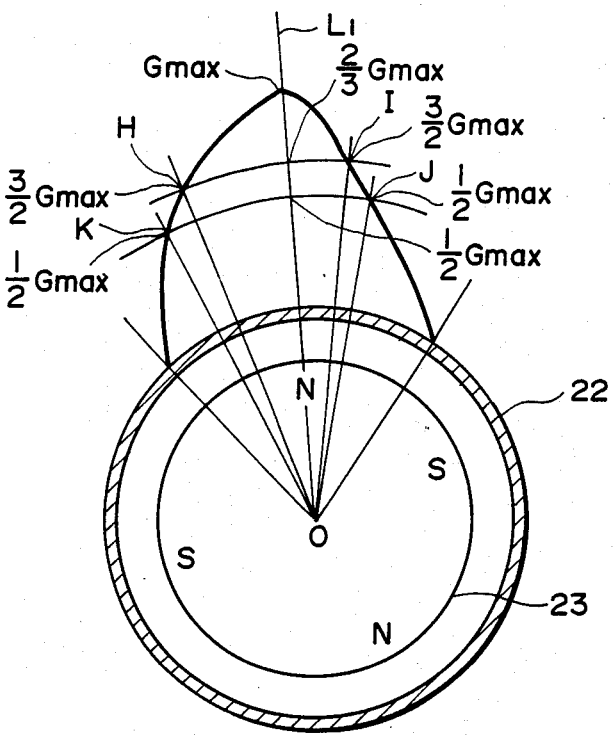
FIG. 11 is a schematic sectional view of a developing apparatus illustrating the magnetic flux density distribution on the of the sleeve, commonly for a developing magnetic pole and a regulating magnetic pole.

Referring to FIG. 11, preferable conditions will be further described.

In FIG. 11, the magnetic pole N is the developing pole or the regulating pole described hereinbefore. The maximum magnetic flux density Gmax on the surface of the sleeve 22 occurs on a line L1 passing through a center O of the magnet roll 23.

As described hereinbefore, the advantages against the manufacturing variations can be provided if an increasing rate A of the magnetic flux density in the upstream of the line L1 with respect to the movement direction of the surface of the sleeve 22 is larger than a decreasing rate B of the magnetic flux density in the downstream thereof in the area of the sleeve surface wherein the magnetic flux density is not less than $\frac{1}{2}\times$Gmax. However, in the case where the maximum magnetic flux density Gmax of the magnetic pole N is smaller, for example, smaller than 800 Gausses, the advantages can be provided if the $B<A$ is satisfied in the area of the surface of the sleeve wherein the magnetic flux density is not less than $\frac{2}{3}\times$Gmax, further preferably, in the area on the sleeve surface where the magnetic flux density is not less than 400 Gausses, then the developing operation can be performed stably in a high speed developing operation.

Where the diameter of the sleeve is not more than 40 mm, the advantageous effects of the present invention can be provided if the increasing rate A is in the range between 5–25 degrees (inclusive) as measured from the line L1 toward the upstream side as seen from the center O (angle $a_2$), and the decreasing rate B is in the range between 10 degrees and 35 degrees (inclusive) as measured from the line L1 toward the downstream (angle $a_1$), and $a_2 \geqq a_1$.

The half-peak width angle (the angle formed between line KO and a line OJ) is preferably not less than 30 degrees and not more than 60 degrees, and further preferably not less than 35 degrees and not more than 55 degrees when external disturbances are considered.

Assuming that the magnetic pole N is a developing pole, a good developing operation can be performed over a wide range from a low speed to a high speed, particularly in the case where an alternating electric field is formed in the developing zone, when the requirement of $B<A$ is satisfied on the sleeve surface within the range between the points K and J. For the sleeve having a diameter not more than 40 mm, the half-peak width angle (the angle formed between the line KO and the line OJ) is preferably not less than 40 degrees, and further preferably not less than 45 degrees in the case of four pole arrangement, and it is preferably not less than 30 degrees in the case of six pole arrangement.

The present invention is particularly advantageously applicable to a developing method or apparatus wherein a volumetric ratio of the total volume of the magnetic particles existing at the developing position to a volume of space defined by the surface of the electrostatic latent image bearing member and the developer carrying member at the developing position, is 1.5–30%, and further particularly, the method and apparatus wherein an alternating electric field is formed in the developing zone.

The above described asymmetrical magnetic flux distribution by the magnetic pole can be provided by known methods, for example, by partly cutting away the surface of the circumference of the magnet roll at a portion downstream of the magnetic pole to provide a less steep inclination of the magnetic flux density change.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image on an electrostatic latent image bearing member, comprising:

a container for containing a developer that includes toner particles and magnetic particles;

a developer carrying member, opposed to the electrostatic latent image bearing member, for forming a developing position for supplying the toner particles to the latent image bearing member and for carrying the developer from said container to the developing position;

magnetic field generating field generating means disposed across said developer carrying member from the latent image bearing member for generating a magnetic field;

developer regulating means for regulating the developer that includes the toner particles and carrier particles and which is carried to the developing position;

wherein said magnetic field generating means includes one magnetic pole adjacent an upstream side of said regulating means with respect to a movement direction of said developer carrying member, and wherein said regulating means is a magnetic field formed by said one magnetic pole, and wherein a distribution of density of magnetic flux which is provided by said one magnetic pole and which is effective to erect chains of the developer on said developer carrying member is such that the density decreases from its maximum less steeply toward a downstream side than toward an upstream side with respect to the movement direction.

2. An apparatus according to claim 1, further comprising means for forming an alternating electric field at the developing position, wherein a volumetric ratio of the total volume of the magnetic particles existing at the developing position to a volume of space defined by the surface of the electrostatic latent image bearing member and the developer carrying member at the developing position, is 1.5–30%.

3. An apparatus according to claim 2, wherein the developer is contacted to the electrostatic latent image bearing member at the developing position, and wherein toner particles on the developer carrying member and on the magnetic particles are transferred to the electrostatic latent image bearing member at the developing position.

4. An apparatus according to claim 1, wherein said regulating means includes a non-magnetic blade provided with a magnetic member at its side near said one pole, and wherein the non-magnetic blade and the magnetic member are disposed downstream of a position of the maximum flux density with respect to the movement direction.

5. An apparatus according to claim 1, 2 or 4, further comprising a developer guiding surface disposed upstream of said developer regulating means with respect to the movement direction, wherein a clearance between the guiding surface and the developer carrying member decreases toward downstream with respect to the movement direction, the guiding surface being opposed to a position of the maximum density.

6. A developing apparatus for developing an electrostatic latent image on an electrostatic latent image bearing member, comprising:

a developer carrying member opposed to the electrostatic latent image bearing member for forming a developing position with a clearance;

means for forming a layer of developer that includes magnetic particles and toner particles on a surface of said developer carrying member; and a developing magnetic pole disposed across said developer carrying member from the latent image bearing member to provide a magnetic field for erecting chains of developer on said developer carrying member at the developing position, w herein said developing magnetic pole provides on the surface of the developer carrying member a distribution of density of magnetic flux which is effective to erect the chains of the developer on said developer carrying member, the distribution being such that the density decreases from its maximum less steeply toward a downstream side than toward an upstream side with respect to a movement direction.

7. An apparatus according to claim 6, further comprising means for forming an alternating electric field at the developing position, wherein a volumetric ratio of that total volume of the magnetic particles existing at the developing position to a volume of space defined by the surface of the electrostatic latent image bearing member and the developer carrying member at the developing position, is 1.5–30%.

8. An apparatus according to claim 7, wherein the developer is contacted to the electrostatic latent image bearing member at the developing position, and wherein toner particles on the developer carrying member and on the magnetic particles are transferred to the electrostatic latent image bearing member at the developing position.

9. A developing apparatus for developing an electrostatic latent image on an electrostatic latent image bearing member, comprising:

a container for containing a developer that includes toner particles and magnetic particles;

a developer carrying member, opposed to the electrostatic latent image bearing member, for forming a developing position for supplying the toner particles to the latent image bearing member and for carrying the developer from said container to the developing position;

alternating electric field generating means for forming at the developing position an alternating electric field having an alternately changing direction between the latent image bearing member and said developer carrying member;

magnetic field generating means disposed across said developer carrying member from the latent image bearing member for generating a magnetic field;

developer regulating means for regulating the developer that includes the magnetic particles and the toner particles and which is carried to the developing position;

wherein said magnetic field generating means includes a regulating magnetic pole adjacent an upstream side of said developer regulating means with respect to a movement direction of said developer carrying member, and wherein said developer regulating means is in a magnetic field formed by the regulating magnetic pole, and said regulating magnetic pole provides a first magnetic flux density effective to erect chains of the developer on said developer carrying member, the density decreasing from its maximum less steeply toward a downstream side than toward an upstream side with respect to the movement direction; and wherein said magnetic field generating means includes a developing magnetic pole actable in the developing position to erect chains of the developer on said developer carrying member, and wherein said developing magnetic pole provides a second magnetic flux density effective to erect chains of the developer, the second density decreasing from its maximum less steeply toward downstream than toward upstream with respect to the movement direction.

10. An apparatus according to claim 9, wherein said regulating means includes a non-magnetic blade provided with a magnetic member at its side near said regulating magnetic pole, and wherein the non-magnetic blade and the magnetic member are disposed downstream of a position of the maximum density with respect to the movement direction.

11. An apparatus according to claim 9 or 10, further comprising a developer guiding surface disposed upstream of said developer regulating means with respect to the movement direction, wherein a clearance between the guiding surface and the developer carrying member decreases toward downstream with respect to the movement direction, the guiding surface being opposed to a position of the maximum density.

12. An apparatus according to claim 11, wherein a volumetric ratio of the total volume of the magnetic particles existing at the developing position to a volume of space defined by the surface of the electrostatic latent image bearing member and the developer carrying member at the developing position, is 1.5–30%.

13. An apparatus according to claim 12, wherein the developer is contacted to the electrostatic latent image bearing member at the developing position, and wherein toner particles on the developer carrying member and on the magnetic particles are transferred to the electrostatic latent image bearing member at the developing position.

14. An apparatus according to claim 9 or 10, wherein a volumetric ratio of the total volume of the magnetic particles existing at the developing position to a volume of space defined by the surface of the electrostatic latent image bearing member and the developer carrying member at the developing position, is 1.5–30%.

15. An apparatus according to claim 14, wherein the developer is contacted to the electrostatic latent image bearing member at the developing position, and wherein toner particles on the developer carrying member and on the magnetic particles are transferred to the electrostatic latent image bearing member at the developing position.

* * * * *

UNITED STATES PATENT AND TRADEMARK OFFICE

CERTIFICATE OF CORRECTION

PATENT NO. : 4,887,131

DATED : December 12, 1989

INVENTOR(S) : MASAHIDE KINOSHITA, ET AL.

It is certified that error appears in the above-identified patent and that said Letters Patent is hereby corrected as shown below:

ON THE TITLE PAGE,
IN [57] ABSTRACT

Line 12, "magentic" should read --magnetic--.

COLUMN 6

Line 14, "embodiment" should read --another embodiment--.
Line 15, "view" should read --views--.
Line 29, "to" should read --according to--.
Line 33, "the" should read --the surface--.

COLUMN 9

Line 19, "property" should read --properly--.

COLUMN 10

Line 14, "relocated" should read --relocate--.

COLUMN 11

Line 17, "to the" should read --to be--.

COLUMN 16

Line 18, "of brought" should read --is brought--.
Line 41, "!less" should read --less--.

UNITED STATES PATENT AND TRADEMARK OFFICE

CERTIFICATE OF CORRECTION

PATENT NO. : 4,887,131

DATED : December 12, 1989

INVENTOR(S) : MASAHIDE KINOSHITA, ET AL.

It is certified that error appears in the above-identified patent and that said Letters Patent is hereby corrected as shown below:

COLUMN 18

Line 9, "ers" should read --er--.

COLUMN 20

Line 57, "which" should be deleted.

COLUMN 22

Line 26, "field generating" (second occurrence) should be deleted.
Line 39, "is a" should read --is in a--.

COLUMN 23

Line 24, "w" should read --wherein--.
Line 25, "herein" should be deleted.

Signed and Sealed this

Twenty-first Day of April, 1992

*Attest:*

HARRY F. MANBECK, JR.

*Attesting Officer*

*Commissioner of Patents and Trademarks*